United States Patent [19]

Feng

[11] Patent Number: 5,029,707

[45] Date of Patent: Jul. 9, 1991

[54] TOOL BOX

[76] Inventor: Yee-Chang Feng, 2F, No. 166-5, Hsi Twen Rd., Sec. 3, Tai Chung City, Taiwan

[21] Appl. No.: 570,444

[22] Filed: Aug. 21, 1990

[51] Int. Cl.[5] ..... B65D 85/20

[52] U.S. Cl. ..... 206/374; 206/375; 211/70.6

[58] Field of Search ..... 206/370–379, 206/443; 211/60.1, 69.1, 69.2, 69.9, 70.6, 70.7; 312/129, 130

[56] References Cited

U.S. PATENT DOCUMENTS

| | | | |
|---|---|---|---|
| 291,704 | 1/1884 | Felch | 206/372 |
| 331,011 | 11/1885 | Thompson | 211/70.6 |
| 1,158,916 | 11/1915 | Goldsmith | 206/371 |
| 1,352,490 | 9/1920 | Wilkins | 211/70.6 |
| 2,584,219 | 2/1952 | Murrell | 206/443 |
| 3,145,031 | 8/1964 | Wilkinson | 211/70.6 |
| 4,140,256 | 2/1979 | King | 206/373 |
| 4,241,773 | 12/1980 | Personnat | 206/373 |
| 4,641,755 | 2/1987 | Oliver et al. | 211/60.1 |
| 4,936,467 | 6/1990 | Bobeczko | 211/60.1 |

*Primary Examiner*—Jimmy G. Foster

*Attorney, Agent, or Firm*—Varndell Legal Group

[57] ABSTRACT

A compact tool box capable of being neatly hung for a screwdriver having a driving handle selectively securing thereto one of a plurality of different driving pieces is provided. The tool box includes a base plate spacedly mounting thereon a plurality of vertical supporters, and a plurality of vertically spaced positioners each of which includes a plurality of positioning indentations and is held attached to the supporters in a manner that the supporters and the positioners cooperatively generally form a crosssectionally polygonal body having a fully open vertical side from which the driving handle can be inserted into the polygonal body.

7 Claims, 3 Drawing Sheets

TOOL BOX

BACKGROUND OF THE INVENTION

The present invention relates to a box, and more particularly to a tool box.

A screwdriver generally includes a wooden or plastic driving handle and a metal driving piece having an acting end having kinds of shapes and/or sizes. In order to cope with screws having heads of various shapes and/or sizes, it is always necessary that one is provided with numerous screwdrivers having driving pieces having different acting ends which is inconvenient in storage and/or carriage. In an effort to overcome this shortcoming, the screwdriver is designed in order that the driving piece is detachable from the driving handle so that one driving handle can be accompanied with numerous driving pieces. A tool box for receiving the driving handle and the driving pieces is always designed to include a box body having horizontal grooves of various length, width and/or depth for respectively receiving therein the driving handle and the driving pieces, and a box cover for covering the box body. Such tool box, however, is relatively bulky, and is apparently mute when it is on display for sale. In addition, it is inconvenient to store such tool box and uneasy to suitably display such tool box for sale.

SUMMARY OF THE INVENTION

It is therefore an object of the present invention to provide a compact tool box for a screwdriver having detachable driving handle and driving pieces.

It is further an object of the present invention to provide a tool box being apparently compact and convenient in storage.

According to the present invention, a tool box for a screwdriver having a driving handle capable of selectively securing thereto one of a plurality of driving pieces having a different end shape and/or size includes a base plate, a plurality of vertical supporters spacedly mounted on the base plate, and a plurality of vertically spaced positioners each of which includes a plurality of positioning indentations and is held attached to the vertical supporters in a manner that the supporters and the positioners cooperatively generally form a crosssectionally polygonal body having a fully open vertical side from which the driving handle can be inserted into the polygonal body. The present invention may best be understood through the following description with reference to the accompanying drawings, in which:

DETAILED DESCRIPTION OF THE PREFERRED EMBODIMENT

Figure 1:
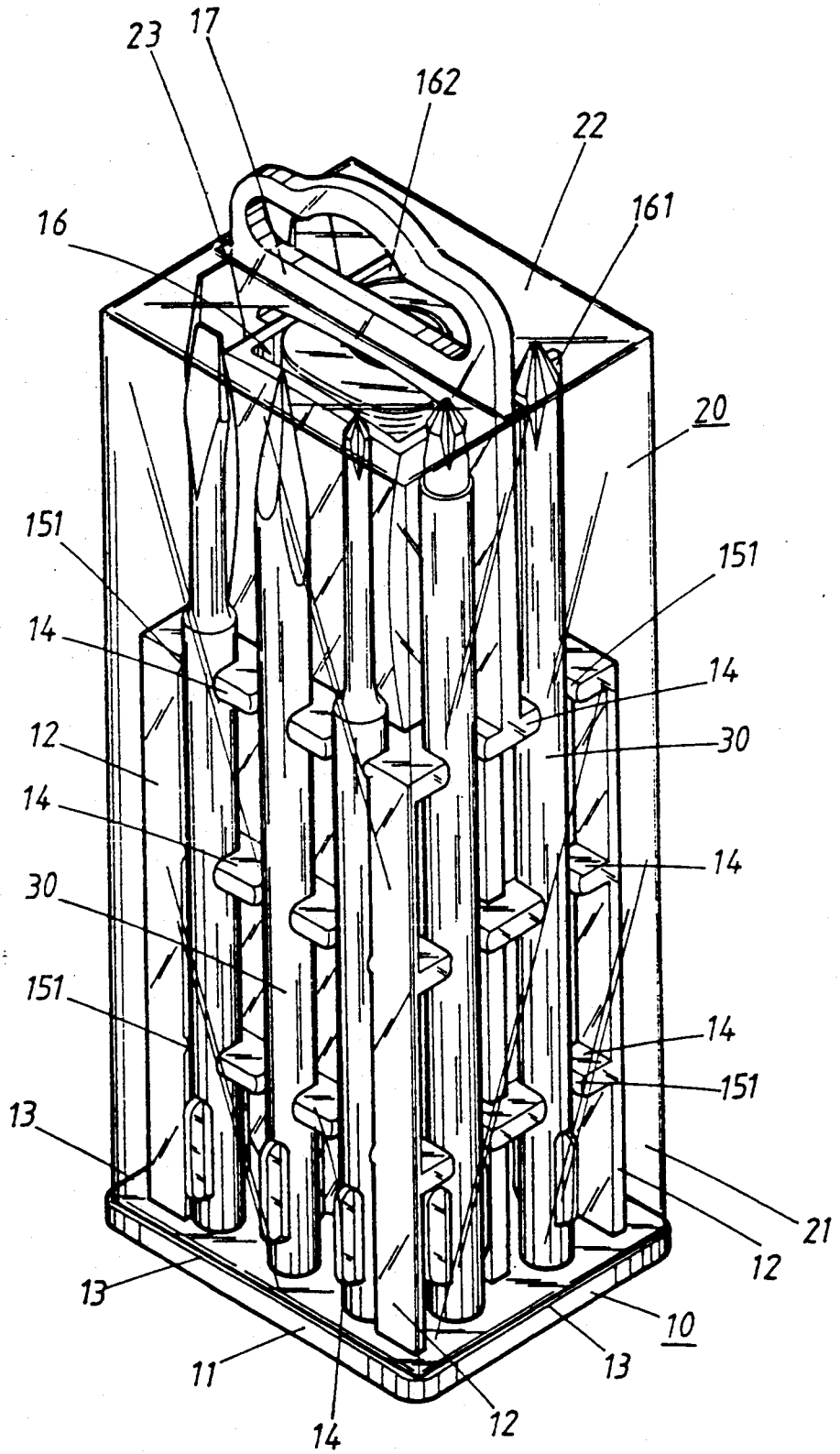
FIG. 1 is a perspective view showing a preferred embodiment of a tool box for a screwdriver according to the present invention.
Figure 2:
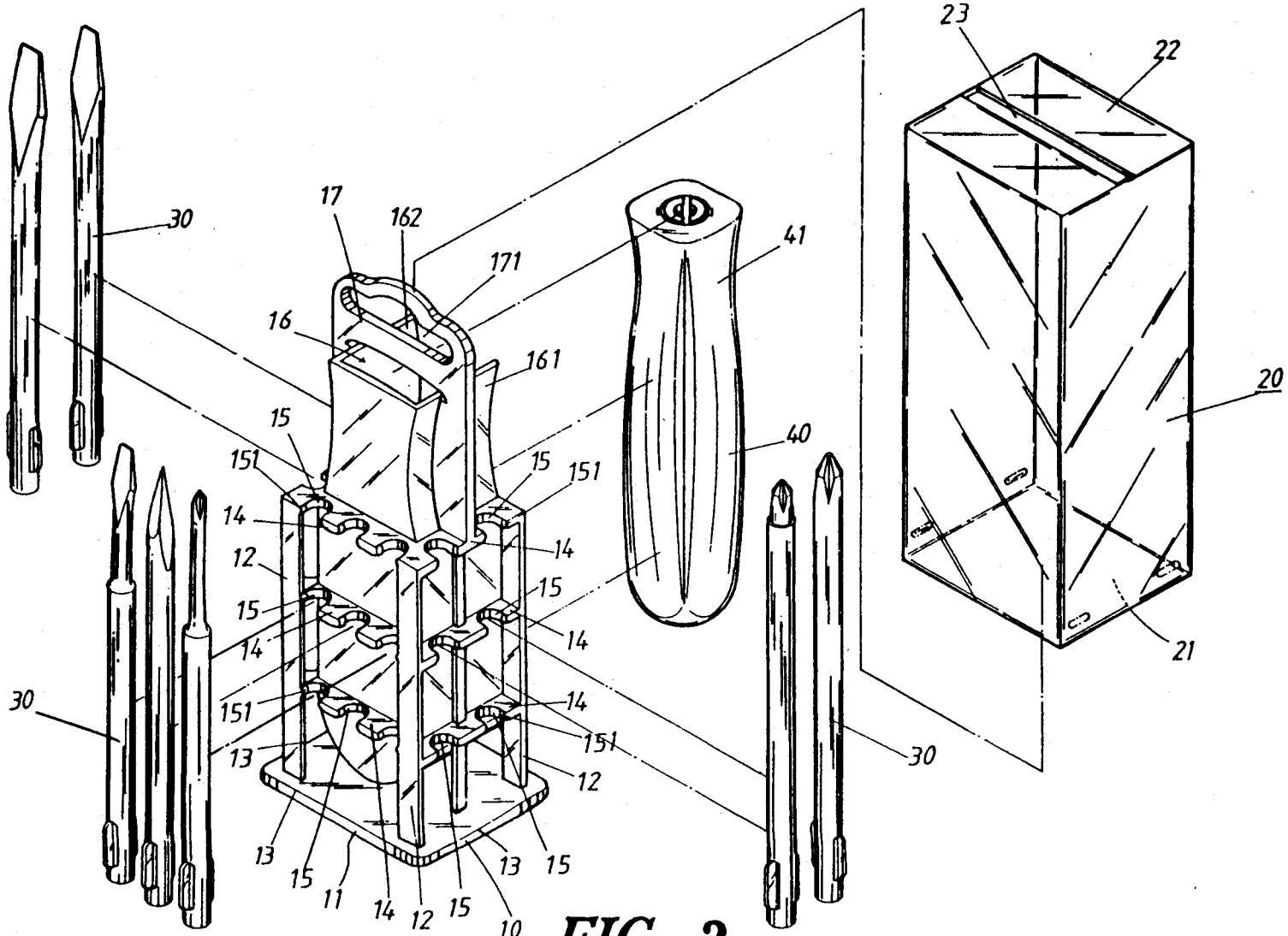
FIG. 2 is an exploded view showing a tool box in FIG. 1.
Figure 3:
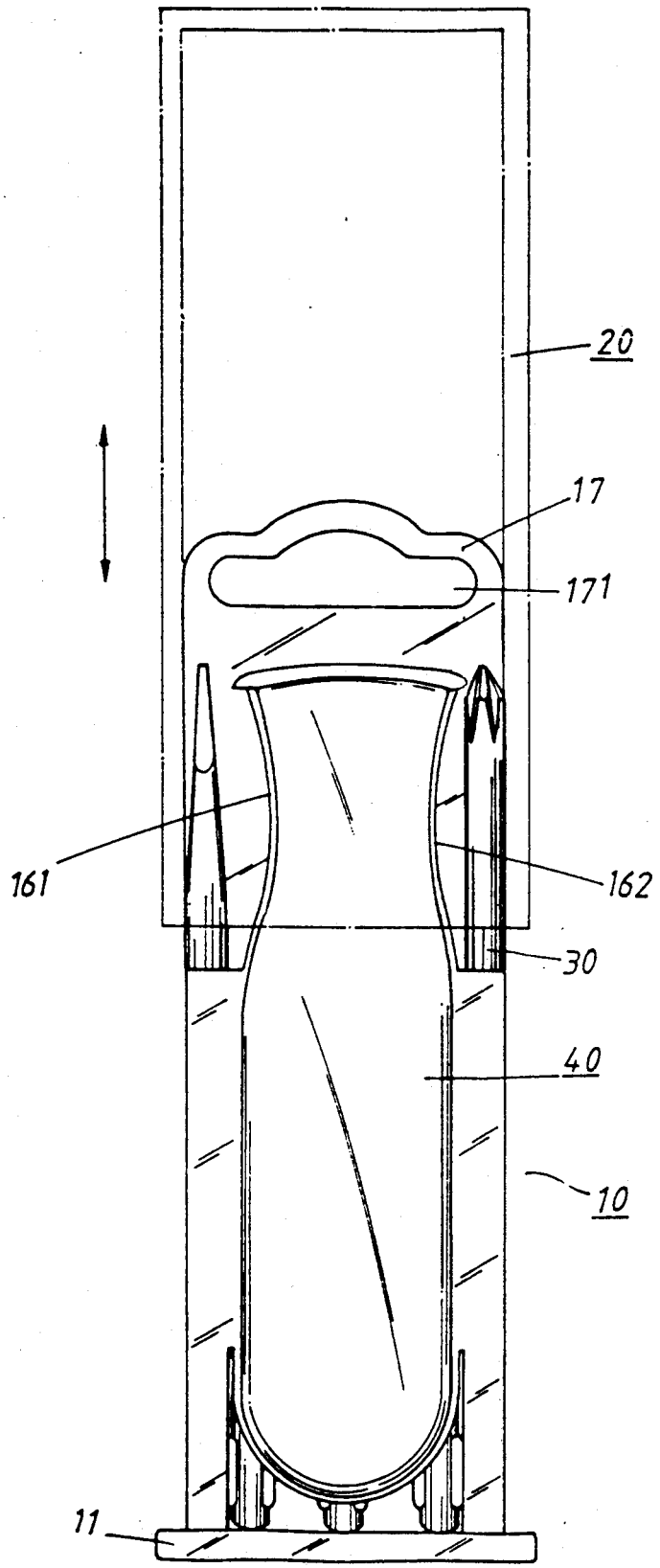
FIG. 3 is a schematical view showing a rear view of a tool box for a screwdriver in FIG. 1.

Referring now to FIGS. 1-3, a tool box for a screwdriver having a driving handle 40 capable of selectively securing thereto one of a plurality of driving pieces 30 having a different end shape and/or size according to the present invention includes a base plate 11 spacedly mounting thereon a plurality of vertical supporters 12, a plurality of vertically spaced positioners 14 each of which includes a plurality of positioning indentations 15 and is held attached to supporters 12 in a manner that supporters 12 and positioners 14 cooperatively generally form a crosssectionally square body 10 having a fully open side from which driving handle 40 can be inserted into crosssectionally square body 10, and a transparent cover 20.

Body 10 can be integrally formed, e.g. by injection molding. Base plate 11 has 4 peripheral surfaces 13 short of which supporters 12 are mounted on plate 11. Each indentation 15 is generally U-shaped and has an open end thereof provided with two diametrically opposite and relatively small protuberances 151 for better retaining driving piece 30 in indentation 15.

Body 10 includes a chamber 16 having two inwardly concave top side walls 161 resiliently matching therebetween a neck portion 41 of driving handle 40 for better retaining driving handle 40 in body 10 further having a top extension 17 having a hanging hole 171.

Cover 20 has a bottom opening 21, a top surface 22 having a slot 23, and a wall thickness substantially equal to the distance between the respective supporter 12 and the respective peripheral surface 13.

Thus, each driving piece 30 can be preferably secured in corresponding indentations 15 of vertically spaced positionres 14. When cover 20 is covered on body 10, top extension 17 protrudes through slot 23 so that one can hang the present tool box by allowing hole 171 passing therethrough a hanging medium.

Through the above description, it should now become readily apparent how and why the present invention can achieve the objects it contemplates.

I claim:

1. A tool box for a screwdriver having a driving handle capable of selectively securing thereto one of a plurality of driving pieces having a different end shape and/or size, comprising:

a base plate;

a plurality of vertical supporters spacedly mounted on said base plate; and a plurality of vertically spaced positioners each of which includes a plurality of positioning indentations and is held attached to said vertical supporters in a manner that said supporters and said positioners cooperatively generally form a crosssectionally polygonal body having a fully open vertical side from which said driving handle can be inserted into said polygonal body.

2. A tool box according to claim 1, further comprising a cover having a bottom opening from which said supporters and said positioners can be received in said cover.

3. A tool box according to claim 2 wherein said cover has a top slot and said ploygonal body has a top extension having a hanging hole and protruding through said top slot of said cover when said cover is covered on said polygonal body.

4. A tool box according to claim 2 wherein said cover is transparent.

5. A tool box according to claim 2 wherein each of said indentations is generally U-shaped and has an open end thereof provided with two diametrically opposite and relatively small protuberances for better retaining said one driving piece in said each indentation.

6. A tool box according to claim 2 wherein said supporters integrally form thereto said positioners.

7. A tool box according to claim 2 wherein said polygonal body includes two inwardly concave top sides for better retaining said driving handle in said polygonal body.

* * * * *